US005224598A

United States Patent [19]

Angeles et al.

[11] Patent Number: 5,224,598

[45] Date of Patent: Jul. 6, 1993

[54] PLANT PACKAGE

[75] Inventors: James P. Angeles, Cleveland; John R. Nottingham, Moreland Hills; Dale A. Panasewicz, Strongsville; William S. Shore, Richmond Heights; Brian J. Sroub, Shaker Heights, all of Ohio

[73] Assignee: Home Environmental Products, Inc., Willoughby, Ohio

[21] Appl. No.: 850,625

[22] Filed: Mar. 13, 1992

[51] Int. Cl.[5] ..... B65D 81/22; B65D 85/52

[52] U.S. Cl. ..... 206/423; 47/84; 47/85

[58] Field of Search ..... 47/66, 68, 69, 73, 84, 47/85; 206/45.34, 423

[56] References Cited

U.S. PATENT DOCUMENTS

| | | | |
|---|---|---|---|
| 1,669,617 | 5/1928 | Kennedy | 206/423 |
| 1,909,013 | 5/1933 | Ruzicka . | |
| 1,988,886 | 1/1935 | Wilson . | |
| 2,446,509 | 8/1948 | Fischer . | |
| 2,649,807 | 8/1953 | Ritter . | |
| 2,664,670 | 1/1954 | Mulford . | |
| 2,736,138 | 2/1956 | Buttery | 206/423 |
| 2,739,422 | 3/1956 | Perkins . | |
| 2,774,187 | 12/1956 | Smithers . | |
| 2,994,424 | 8/1961 | Selby et al. . | |
| 3,094,810 | 6/1963 | Kalpin . | |
| 3,205,077 | 9/1965 | Hammond . | |
| 3,225,805 | 12/1965 | Wise | 206/423 |
| 3,266,188 | 8/1966 | Budd . | |
| 3,302,325 | 2/1967 | Ferrand . | |
| 3,314,194 | 4/1967 | Halleck | 47/84 |
| 3,462,061 | 8/1969 | Shore . | |
| 3,640,381 | 2/1972 | Kanada et al. . | |
| 3,704,545 | 12/1972 | Van Reisen | 206/423 |
| 3,738,956 | 6/1973 | Glatti et al. . | |
| 3,748,781 | 7/1973 | Erling | 206/423 |
| 3,857,934 | 12/1974 | Bernstein et al. . | |
| 3,869,828 | 3/1975 | Matsumoto . | |
| 3,874,115 | 4/1975 | London et al. . | |
| 3,962,823 | 6/1976 | Zipperer, III . | |
| 3,973,356 | 8/1976 | Schacht . | |
| 3,995,396 | 12/1976 | Spector . | |
| 4,006,561 | 2/1977 | Thoma et al. . | |
| 4,014,134 | 3/1977 | Womack, Jr. . | |
| 4,014,139 | 3/1977 | Shooter et al. . | |
| 4,019,279 | 4/1977 | Moorman et al. . | |
| 4,075,786 | 2/1978 | Van Zyl | 206/423 |
| 4,079,547 | 3/1978 | Walker . | |
| 4,113,093 | 9/1978 | Hendrickx | 47/84 |
| 4,118,890 | 10/1978 | Shore . | |

(List continued on next page.)

FOREIGN PATENT DOCUMENTS

| | | | |
|---|---|---|---|
| 2220340 | 1/1990 | United Kingdom | 47/84 |

*Primary Examiner*—Jimmy G. Foster

*Attorney, Agent, or Firm*—Calfee, Halter & Griswold

[57] ABSTRACT

A plant package [12] for a live plant having a stem [S], roots [R] and rooting medium [D] surrounding the roots. The package comprises a self-supporting, light transmissive, sealed polymer shell [14] having an internal surface [22] defining a package interior [24]. A shelf [16] is provided on the internal surface, and defines first and second interior compartments [18, 20] for containing the roots and stem, respectively. The portion of the shell defining the first interior compartment has a greater thickness than the portion of the shell defining the second interior compartment, and the second compartment is substantially more permeable to oxygen and carbon dioxide molecules than the first compartment. An inner container [60] is provided for the roots and rooting medium, and an outer container [62] engaged with the internal surface is provided for the inner container. Together the containers and first interior compartment form a substantial water vapor barrier. A semi-rigid divider [28] is engaged with the stem, shelf and container, and forms a water vapor barrier intermediate the interior compartments. The divider includes a compressible material for form fitting engagement with the containers and live plant stem, and a material engaged with the shelf which is substantially impermeable to the passage of water vapor between the interior compartments.

25 Claims, 6 Drawing Sheets

U.S. PATENT DOCUMENTS 4,136,502 1/1979 Shore .
4,189,868 2/1980 Tymchuck et al. .
4,242,835 1/1981 Sorribes .
4,248,347 2/1981 Trimbee .
4,265,049 5/1981 Gorewitz .
4,292,761 10/1981 Krave .
4,411,921 10/1983 Woodruff .
4,413,725 11/1983 Bruno et al. .
4,423,080 12/1983 Bedrosian et al. .
4,554,761 11/1985 Tell .
4,603,077 7/1986 Fujimoto et al. .
4,621,733 11/1986 Harris .
4,735,308 4/1988 Barner .
4,741,440 5/1988 Harris .
4,903,431 2/1990 Stoll .
4,908,315 3/1990 Kertz .
4,910,032 3/1990 Antoon, Jr. .
4,923,703 5/1990 Antoon, Jr. .
4,936,046 6/1990 Miller .
5,001,860 3/1991 Rudnick .
5,029,708 7/1991 Alonso .

PLANT PACKAGE

TECHNICAL FIELD

The present invention relates to a package for live plants, and more particularly to a low maintenance, sealed plant package for shipment, storage, display, sale, and transportation by consumers of the live plants.

BACKGROUND OF THE INVENTION

Most live plants are fragile and require special attention for shipment, storage, display and sale. In order to survive, live plants must be given proper care, including proper lighting, watering and protection from insects, fungus and bacteria. However, during display of the plant prior to sale, it must also be readily visible to the potential consumer, while at the same time be protected from handling by the consumer. This combination of requirements has made live plants a difficult consumer product to package and market for purposes of sale through conventional self-service retail sales channels, such as gift, department and grocery stores.

The plant package shown in U.S. Pat. No. 4,118,890 provided solutions to many of the packaging problems faced by prior live plant distributors. However, it was believed that a package which was even more efficient to manufacture, provided more selection in the size and shape of the plants contained therein was required.

SUMMARY OF THE INVENTION

The present invention provides an improved plant package for use in the sale of live plants in self-service retail sales stores, as well as other sales methods such as mail order, and which enables the successful shipment, storage and sale of healthy live plants. This improved, simple to manufacture plant package protects live plants from external damage such as shipping, insects, fungus, bacteria and consumer handling, and at the same time provides the plant with the necessary water, nutrition and better light distribution for successful storage and display prior to consumer sale.

The plant package of the present invention includes a self-supporting, light transmissive, sealed shell formed by first and second elements which together form an internal surface defining a package interior. The sealed shell includes a shelf formed on the internal surface which defines two interior compartments within the shell for containing: i) the roots and rooting medium of the plant, and ii) the stem or stems and foliage. Inner and outer containers are provided for supporting the roots and rooting medium of the plant within the shell. The inner container maintains the roots and rooting medium, and the outer container supports the inner container and within the interior root compartment of the shell.

A semi-rigid divider is positioned within the shell engaged with the stem or stems and securely positioned between the shelf and containers. The divider forms a barrier to reduce the passage of water vapor between the interior compartments. The divider may be provided with a number of different layers having various purposes, including positioning the inner and outer containers with respect to one another, maintaining the containers properly positioned within the interior root compartment, maintaining the roots and rooting medium within the inner container, conforming to and supporting the stem or stems and assisting in providing better light distribution for the lower plant foliage.

Together, the containers, shell and divider provide the water vapor barrier between the shell compartments.

The shell of the plant package may be formed of separate pieces, or as a single unit having the elements hinged together. The wall portion of the shell defining the root compartment has a thickness which allows better support and handling of the overall plant package, and which is substantially impermeable to water, and supports the containers. The wall portion of the shell defining the foliage compartment is thinner than that of the root compartment and is substantially more permeable to oxygen and carbon dioxide molecules. Additionally, the wall portion of the shell foliage includes a spherical portion. The spherical portion and the center of the wall portion are thicker, such that the thicker spherical portion provides a form of a lens, and the center portion assists with better handling of the package. The thicker lens portion serves to magnify the live plant for easy viewing by the consumer, and provides better light distribution to the plant.

A seal is provided between the pieces or elements of the shell. By providing a sealed shell having a divider forming the compartments described, the foliage and root of the live plant are maintained in their respective environments which contain the necessary moisture to eliminate regular watering requirements, and protect the plant from insects, fungus, bacteria, viruses and other foreign matter, as well as improper handling.

Other features and advantages of the present invention will become apparent from the following detailed description of the preferred embodiments made with reference to the accompanying drawings.

DETAILED DESCRIPTION

Figure 1:
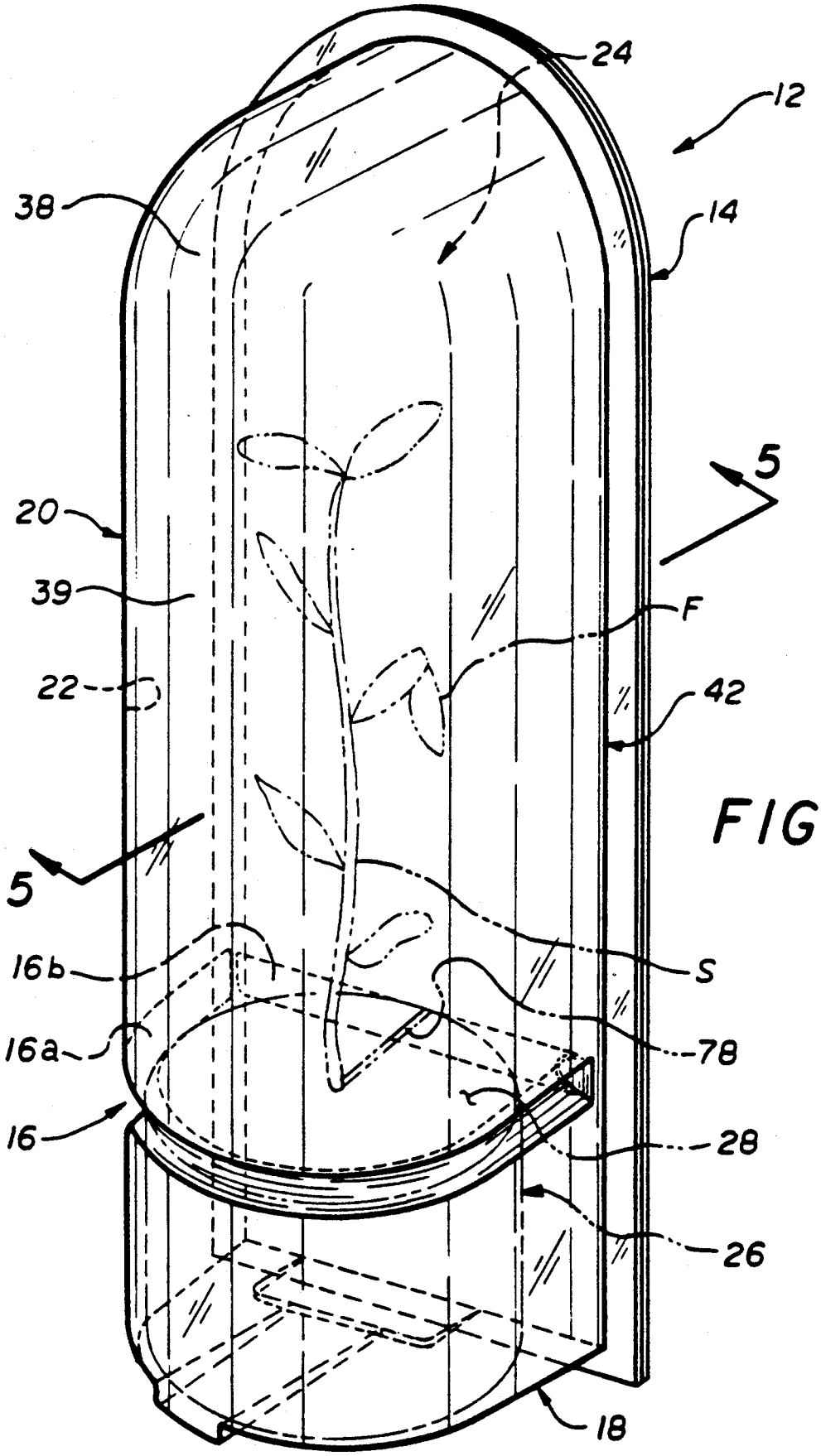
FIG. 1 is a perspective view of a plant package in accordance with the present invention, containing a live plant shown in phantom.

A plant package, indicated generally at reference numeral 12, constructed in accordance with the present invention is illustrated in FIG. 1. The package 12 comprises a shell 14 having a shelf 16 defining a first root interior compartment 18 for containing the roots R and rooting medium D surrounding the roots of the live plant, and a second foliage interior compartment 20 for containing the plant stem S and foliage F. The shell 14 includes an internal surface 22 defining an interior package compartment 24 of the plant package 12. A container 26 for the roots and rooting medium R, D and a divider 28 are also provided.

Figure 2:
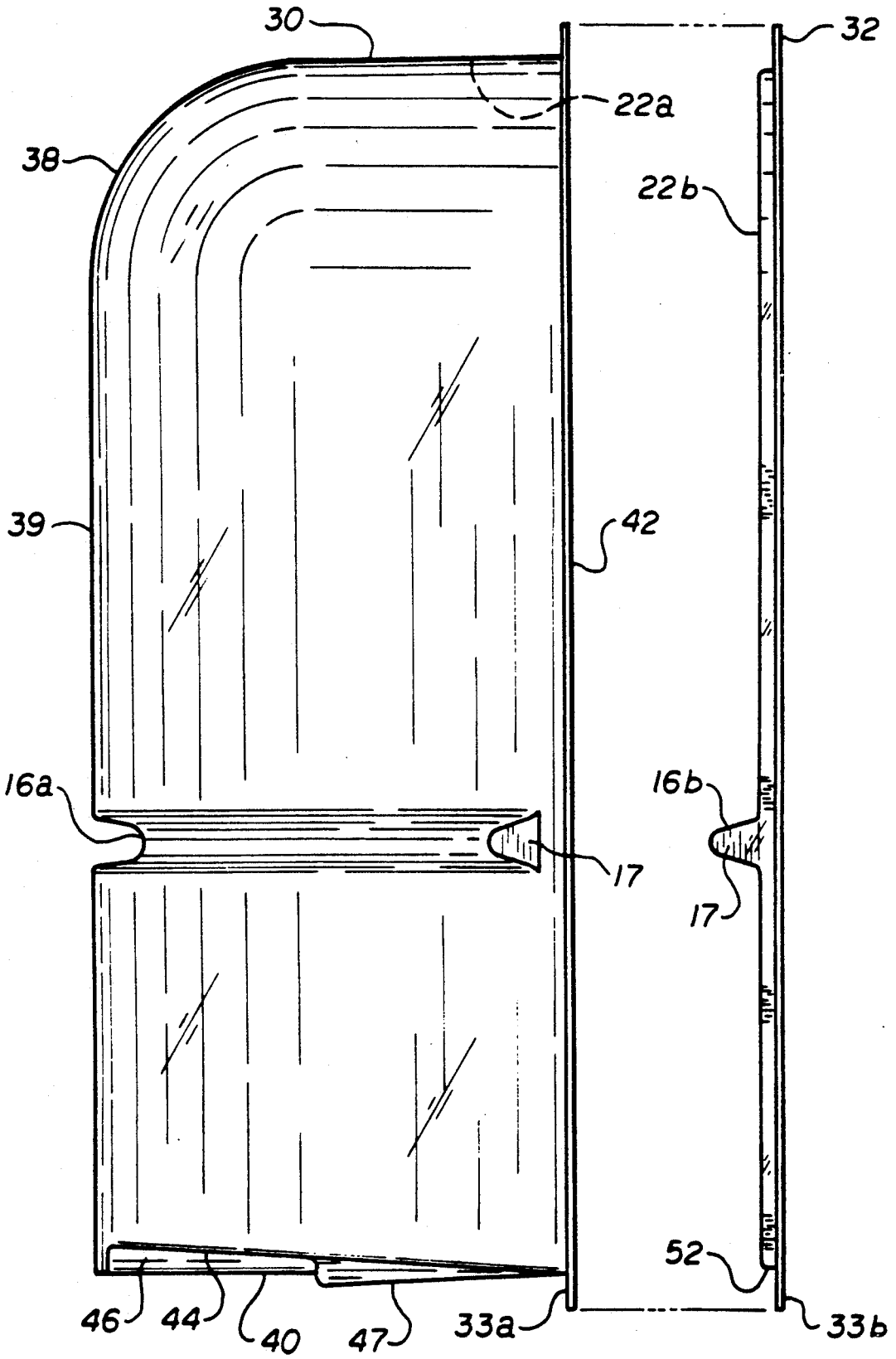
FIG. 2 is a side view of a shell of the plant package of FIG. 1.
Figure 3:
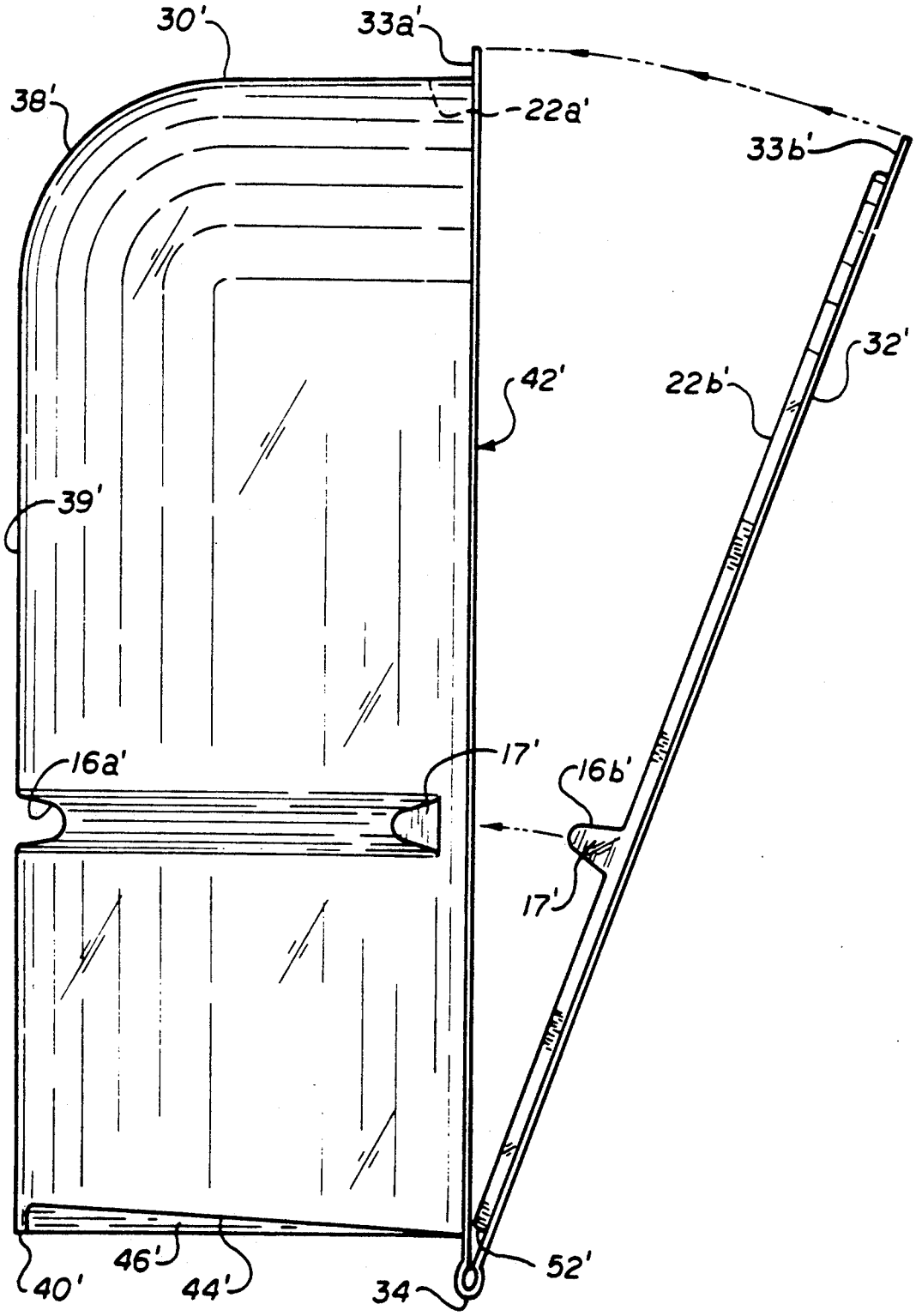
FIG. 3 is a side view of an alternate embodiment of a shell of a plant package constructed in accordance with the present invention.

The shell 14 constructed in accordance with the present invention is illustrated in FIG. 2, and in an alternate embodiment in FIG. 3. As shown, the shell includes a first element 30 and a second element 32. In the embodiment of FIG. 2, the first and second elements are separate pieces, while in the embodiment of FIG. 3, the shell is formed as a single unit, with the first and second elements interconnected by a hinge 34. As the first and second elements forming the shell 14 are substantially identical in the embodiments of FIGS. 2 and 3, only the differences between the embodiments will be discussed further. Where the elements of the FIG. 3 embodiment are identical to the elements of the FIG. 2 embodiment, the same reference numerals will be used for identification, but with a prime designation. Likewise, the still further alternate embodiment of FIG. 6 will be referred to with a double prime designation.

As shown in FIGS. 2 and 3, the shell first and second elements 30, 32, together define the interior package compartment 24. The first and second elements each include a sealing surface 33*a*, 33*b*, internal surfaces 22*a*, 22*b* forming the internal surface 22, and shelf portions 16*a*, 16*b* forming the shelf 16, respectively. The shelf portions 16*a*, 16*b* are substantially U-shaped or convex in configuration and from within the plant interior, and are formed integrally with their respective first and second elements 30, 32. As shown in FIGS. 1–3, the ends 17 of each shelf portion 16*a*, 16*b* are formed in a plane at approximately 45° with respect to the U-shaped cross section of the shelf portions. The ends 17 of each shelf portion 16*a*, 16*b* are thus configured for mating engagement and formation of the continuous shelf 16 surrounding the shell 14, when the first and second elements 30, 32 are in sealed engagement as shown in FIG. 1.

The first shell element 30, 30' has a substantially cylindrical configuration with a spherical top surface 38, a front surface 39, a bottom surface 40, and an opening 42 for mating engagement with the second element 32 intermediate the top and bottom surfaces 38, 40. The sealing surface 33*a* is provided surrounding the opening 42. As illustrated, the top surface 38 of the first element 30 has a spherical configuration. The thickness of the first shelf element 30 in the area of the spherical surface 38 and the front surface 39 is between 5–125 mils thick, however it should be understand that the thickness may be much greater depending upon the particular requirements to be satisfied. With this thickness, the first shell element in the area of the spherical portion provides a form of a lens. The thicker lens portion enables visual magnification of the live plant within the package, and assists with better distribution of light to the second compartment 20 containing the foliage and stems. The thickness in the first shell element in the area of the front surface 39 enables easier handling of the plant package by the consumer.

The bottom surface 40 includes two ramp portions 44 separated by a rib portion 46. The ramp portions are inclined at an angle as shown in FIGS. 2 and 3, to assist with removal of the shell from the mold during manufacture. The rib portion 46 forms an approximately 90° angle with respect to the plane of the second shell element when engaged with the first element. With the rib portion at 90°, the plant package 12 may be readily positioned at eye level on a merchandise shelf for easy viewing of the live plant by consumers.

Figure 5:
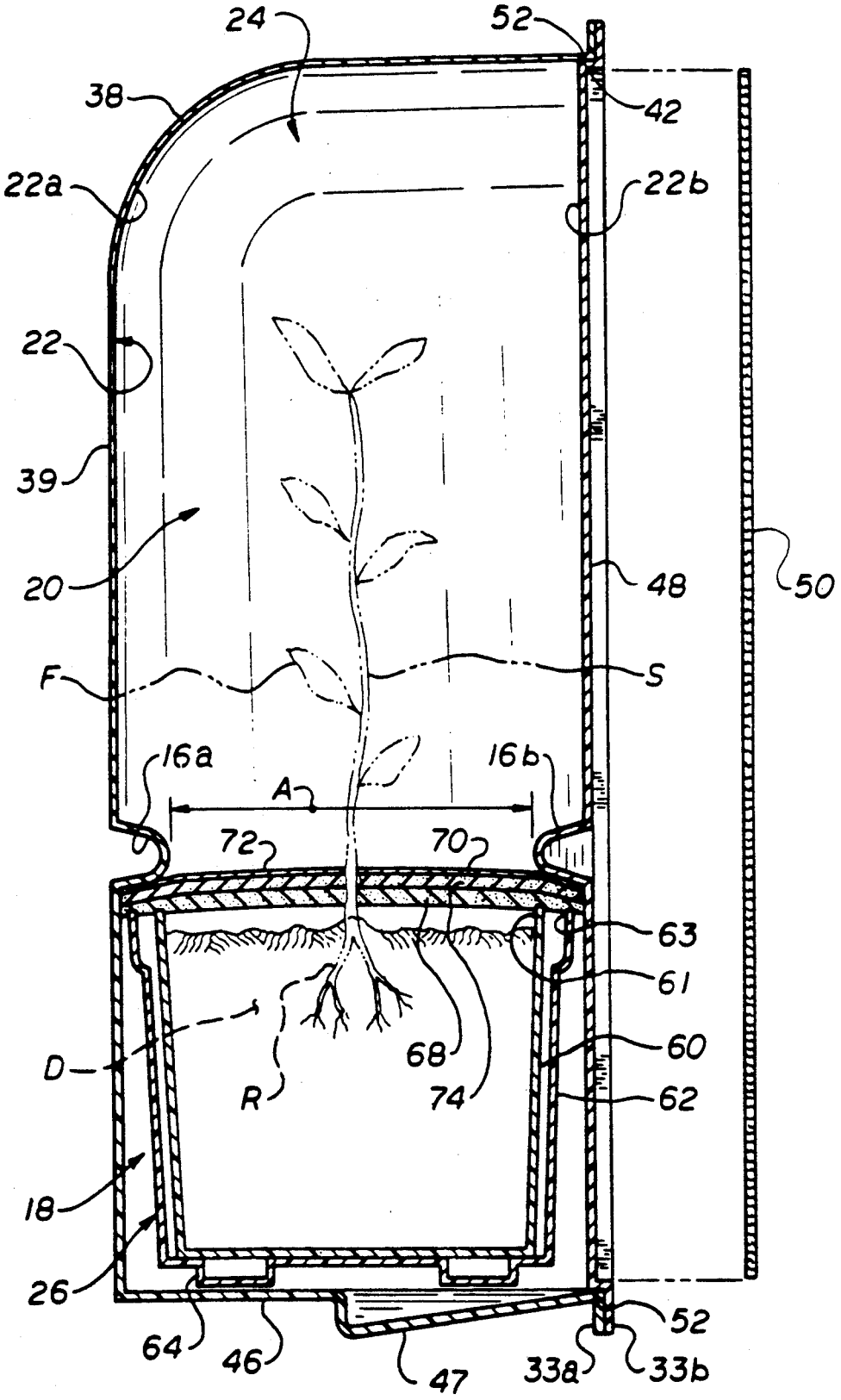
FIG. 5 is a schematic cross-sectional view of the plant package of FIG. 1 taken along the line 5—5, and showing a panel.

The preferred embodiment of FIGS. 1, 2 and 5 additionally includes a platform portion 47. The platform portion provides additional stability and support to the plant package when positioned on a merchandise shelf.

Figure 6:
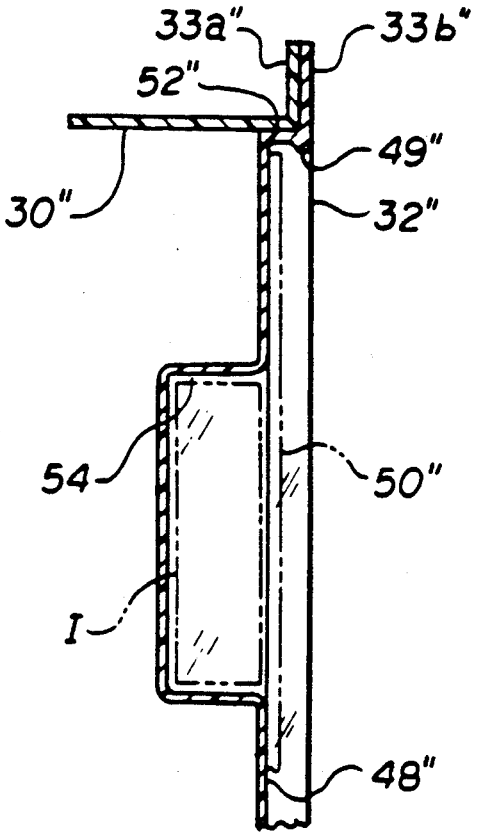
FIG. 6 is a schematic cross-sectional, cut-away view of an alternate embodiment of a portion of the exterior shell of the plant package in accordance with the present invention.
Figure 7:
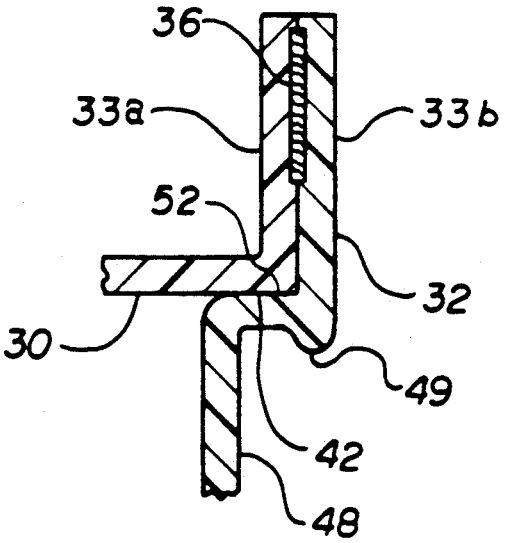
FIG. 7 is a schematic cross-sectional, cut-away view of a seal of a shell of the plant package of the present invention.

The second element 32 is configured for sealed mating engagement within the first element opening 42, and has a substantially flat configuration. The second element is matingly engaged with the first element 30 on an engagement surface 52. It is noted that the opening 42 of the first shell element 30 is of a size slightly smaller than the size of the engagement surface 52 surrounding the second shell element 32. This difference in size provides an interference fit between the first and second shell elements when the engagement surface 52 engages the opening 42. Such a press-fit engagement between these elements serves to strengthen the seal 36 therebetween, and ensure proper sealing of the shell. As best shown in FIG. 5, the second element also includes an inset bed portion 48 for receiving a panel 50 which in the illustrated embodiment provides additional structural support to the shell 14. A bead portion 49 surrounds the insert bed portion, and is on a surface of the second element opposite the engagement surface 52, as shown in FIGS. 6 and 7. The location of the bead portion 49 enables the panel 50 to be snapped into, and maintained in, engagement within the insert bed portion.

The sealing surface 33*b* of the second element surrounds the inset bed portion adjacent the engagement surface 52, and is configured for aligned engagement with the sealing surface 33*a* of the first element. In a further embodiment of the invention, the panel 50 may additionally be provided with printed advertising or consumer information which may be observed by the consumer through both the first and second transparent elements of the shell.

In an alternate embodiment of the invention illustrated in FIG. 6, the second element 32'' is formed with an integral compartment 54, which may be of any desired configuration. The compartment 54 may be used to store and display an additional item of manufacture I to be sold to the consumer in connection with the packaged live plant. In this alternate embodiment, the panel 50'', when positioned within the inset bed portion 48'' maintained by the bead portion 49, serves to maintain the item of manufacture within the compartment 54 for easy observation by the consumer through the transparent elements of the shell.

The shell 14 of the present invention is manufactured from a polymer material, preferably polyethylene terephtlialate glycol ("PETG"), but may also be manufactured of polyvinyl chloride ("PVC") or other coextruded polymer materials. The shell 14 is preferably manufactured by conventional vacuum forming of the polymer material. In particular, manufacture of the first element 30 of the shell is preferably formed using conventional pre-forming or plug-assist vacuum molding techniques which are also well known to those of ordinary skill in the art. Using techniques of this type, portions of the shell may be made in one or more desired thicknesses as may be necessary to permit or prevent maximum or minimum permeation of oxygen and carbon dioxide molecules and water vapor through the shell for the live plant contained therein. Additionally, such variation in shell thickness enables the shell to have the desired rigidity for purposes of supporting the plant or other characteristics, such as the lens feature previously discussed concerning the spherical portion of the first shell element.

The material is transparent to enable the transmission of light to the foliage of the plant, and to enable consumers to visually observe and inspect the foliage of the live plant prior to sale. However, it should be understood that portions of the shell not containing light dependent foliage of the live plant, need not be transparent.

The cycles of plants are well known. In their "daily" cycle, the plant uses carbon dioxide and water during the photosynthesis of light to produce glucose. During photosynthesis, the plant gives off oxygen. During the "night" cycle, the plant uses oxygen to produce carbon dioxide. As a result, the environment within the package is carbon dioxide poor and oxygen rich during the day, and carbon dioxide rich and oxygen poor at night. Since the shell may be manufactured to be permeable by gas molecules at any desired location, the plant package of the present invention permits osmosis of gases to exchange carbon dioxide and oxygen through the shell, and thereby maintain a suitable environment for the plant at all times. Although the shell is permeable in specific sections by gas molecules, water vapor may permeate at a substantially reduced rate, and the shell is impermeable to bacteria, fungus and insects. Thus, the shell is of a material and thickness permitting the necessary intake and escape of gases, while at the same time slowing the rate at which water vapor passes through the shell, and preventing harmful elements such as fungus, bacteria or insects from entering the package interior.

In the preferred embodiments of the present invention, and as shown in FIG. 5, the overall thickness of that portion of the first element 30 of the shell 14 defining the second foliage interior compartment 20 is 2–8 mils. The overall thickness of that portion of the first element 30 of the shell 14 defining the first root interior compartment 18 is 3–30 mils. Thicknesses in these ranges are believed to provide or prevent the desired permeability of gas molecules and water vapor through the shell to the respective compartments 18, 20, and at the same time maintain the self-supporting feature of the shell. However, it should be understood that specific areas of the shell having specific thicknesses to obtain the desired features or characteristics may also be used as set forth above. The range of such thicknesses may be between 5–125 mils, depending on the feature desired.

To reduce the effect of fogging within the shell, the internal surface of the shell may also be provided with any treatment which would lower the surface tension of the package material, e.g. a surfactant or polymer treatment. Any suitable known surfactant or polymer treatment may be used, including nonionic, anionic and cationic surfactants such as those conventionally available from chemical or other suppliers, or a silicone treatment, respectively. The surfactant or polymer treatment reduces the surface tension of water droplets forming on the internal surface 22 of the shell 14, and thus prevents the formation of large water droplets. The prevention of large water droplets prevents fogging on the inside surface of the container. Such fogging decreases the visibility of the live plant to the consumer, and the amount of light transmitted to the plant. Additionally, the absence of large water droplets prevents the foliage of the plant from being damaged by continual contact with water.

The roots R and rooting medium D surrounding the roots of the live plant are maintained within a container 26, which is housed within the first root compartment 18 of the shell. In the preferred embodiment of the present invention shown in FIGS. 4 and 5, the container 26 includes a inner container 60 for housing the roots R and rooting medium D, and an outer container 62 for maintaining the inner container 60. To provide the live plant with the necessary moisture to survive during the time anticipated for shipment, storage and consumer sale, water may be provided within the containers.

Both the inner and outer containers 60, 62 have top openings 61, 63 for receiving the roots and rooting medium and inner container, respectively. The inner container 60 has a diameter smaller than that of the outer container 62. The outer container 62 has feet 64 to raise the container off the internal surface 22. The outer container has a diameter larger than the distance A defined as shown in FIG. 5, between the troughs of the U-shaped shelf 16. These relative diameters are provided to ensure that the container 26 is maintained within the first root compartment 18 of the shell 14 of the plant package 12.

The divider 28 assists with maintenance of the containers 60, 62 in proper position within the first root compartment 18, and of the roots and rooting medium within the containers. The divider 28 is a semi-rigid polymer material which engages the stem S along a cut 78. The divider additionally engages the shelf 16 and the top openings 61, 63 of the inner and outer containers 60, 62. In the plant package of the present invention the divider provides a water vapor barrier between the first and second interior compartments 18, 20. In the illustrated embodiment of FIG. 4, the divider includes three layers. However, it should be understood that one or more layers of any desired material, open or closed cell polymer materials, or other materials, may be used to accomplish the desired purpose.

The first layer 68 of the divider 28 is preferably a semi-rigid foam polymer material which forms a part of the first root interior compartment 18, and may be compressed for form fitting engagement with the top openings 61, 63 of the containers 60, 62. The second layer 70 of the divider is of a polymer material substantially impermeable to the passage of vapor, and which is engaged with the shelf 16 and forms a part of the second foliage interior compartment 20. The second layer 70 may be provided with a coating 72 which is a reflective material such as polyester film. The coating 72 assists in providing light to the live plant foliage and stem within the foliage compartment and compartment 20.

In the preferred and illustrated embodiment, a third layer 74 of a more compressible polymer material than either the first or second material layers is provided between the first and second layers. The compressible layer is provided to conform and surround the stems S, and to assist the first and second layers in engagement with the shelf 16 and top openings 61, 63 of the containers. However, it should be understood that the third additional layer is preferred but not required. The divider, together with containers and first shell compartment, provide a water vapor barrier to both the second compartment and the external shell surface.

During packaging of the live plant into the plant package 12, the live plant within the inner container 60 or grower's pot is placed within the outer container 62. Before the live plant is provided within the first element of the shell, any desired surfactant or nutrient materials are provided on the inner surface **22*a* of the first element 30. It should be understood, as set forth in U.S. Pat. No. 4,118,890, that certain surfactant materials may be added to the polymer material during the manufacture of the material or its formation. Additionally, any necessary nutrients or moisture may be provided to the container 26** or rooting medium D at this time.

Figure 4:
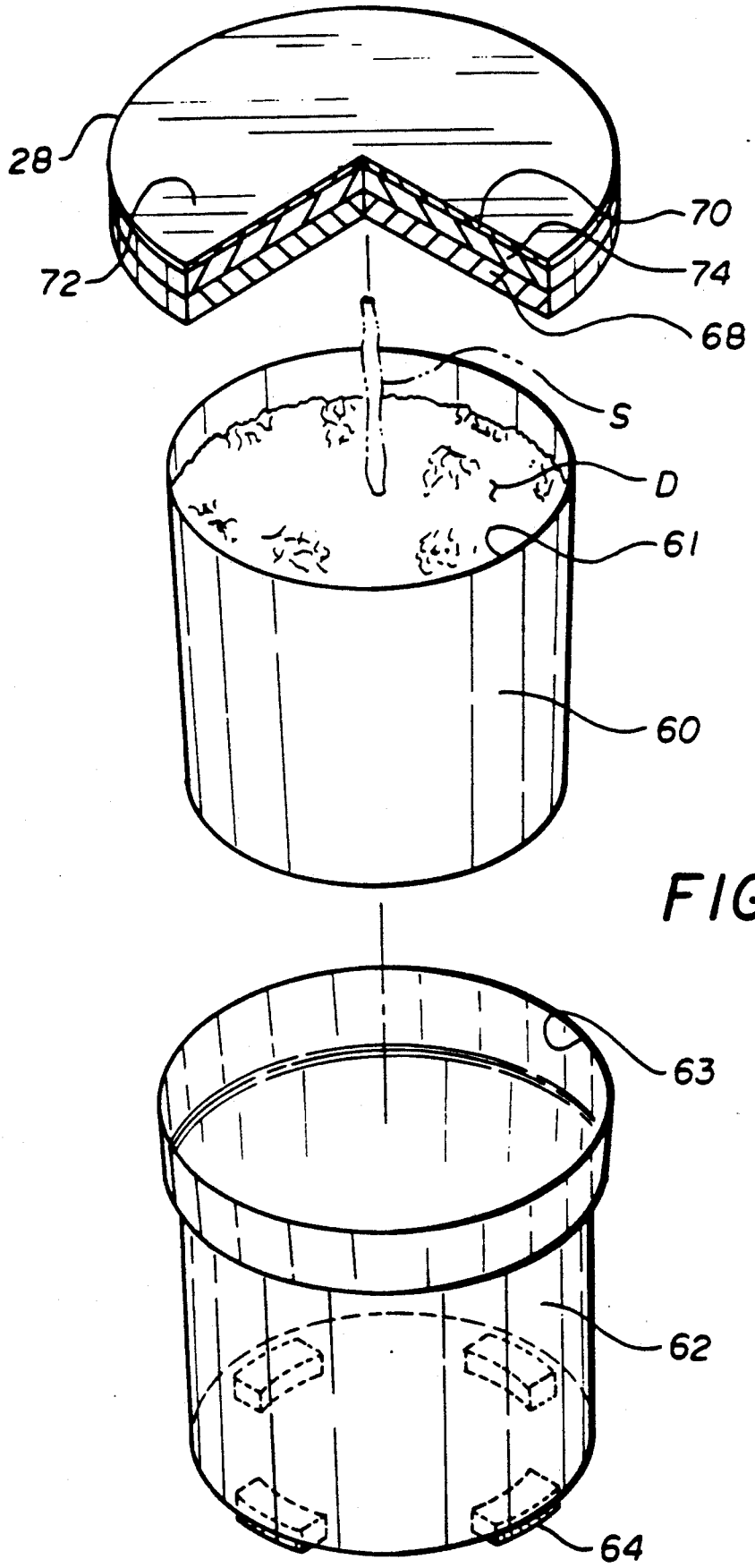
FIG. 4 is a perspective schematic view of inner containers and a divider of a plant package in accordance with the present invention.

The divider 28 is then positioned such that the cut 78 surrounds the stem S, and the divider covers the rooting medium D and the top openings 61, 63 of the containers 60, 62, in the order shown in FIG. 4. Once this process is completed, the container 26 is placed on the inner surface 22*a* of the first root compartment 18 of the first element 30 of the shell 14. In this position, the second layer 70 having the coating 72 is engaged with the shelf 16*a*.

Engagement of the divider 28 with this portion of the shelf compresses the first layer 68 of the divider into engagement with the top openings 61, 63 of the containers as shown in FIG. 5. The material layers of the divider enable substantial sealing engagement of the divider with the stem and the containers, which effectively separates the first and second interior compartments 18, 20. In the event it is desired to add carbon dioxide to the first element of the shell before it is sealed, this gas is now added.

The inset bed portion 48 of the second shell element 32 is then engaged within the opening 42 of the first shell element along the engagement surface 52. In the embodiment of the shell shown in FIG. 2, the first and second elements 30, 32 are simply engaged together. In the embodiment of the shell shown in FIG. 3, the hinged elements 30', 32' are moved into engagement in the direction of the illustrated arrows. With the engagement of the first and second elements, the continuous shelf 16 is formed and the separation between the compartments 18, 20 provided by the divider 28 is accomplished.

The seal 36 shown in FIG. 7 is then provided between the sealing surfaces 33*a*, 33*b* of the first and second elements of the shell 14. The seal 36 is preferably provided by heat, but may be provided by glue or other physical means which prevent the passage of water vapor, insects, fungus or bacteria from passing through the seal and shell. Once the seal 36 is in place, the divider 28 and shelf 16 provide a barrier which, despite movement of the plant package out of the upright position, prevents the container 26 from moving out of position within the root compartment 18 and protects the plant foliage F.

While a preferred embodiment of the invention has been disclosed in detail, along with certain alternative constructions and arrangements, the present invention is not to be considered limited to the precise constructions disclosed herein. Various adaptations, modifications and uses of the invention may occur to those skilled in the art to which the invention relates, and the invention is to cover all such adaptations, modifications and uses falling within the spirit and scope of the following claims.

We claim:

1. A plant package for a live plant having a stem, roots and rooting medium surrounding the roots, comprising:

a self-supporting, light transmissive, sealed shell having an internal surface defining a package interior, and a shelf on said internal surface, said shell shelf defining first and second interior compartments of said shell for containing said roots and stem, respectively, a container for said roots and rooting medium surrounding said roots, engaged within said first interior compartment, and a semi-rigid divider engaged with said stem, shelf and container, and forming a vapor barrier intermediate said first and second interior compartments.

2. The plant package of claim 1, wherein said shell comprises first and second elements, each of said elements having an internal surface forming a portion of said package interior, and a shelf.

3. The plant package of claims 1 or 2, wherein said divider includes a first surface forming a part of said first interior compartment and of a material for compression and supporting form fitting engagement with said container, and a second surface engaged with said shelf and forming a part of said second interior compartment and of a material to reduce the passage of water vapor between said first and second interior compartments.

4. The plant package of claim 3 wherein said container comprises an inner container for said roots and rooting medium surrounding said roots, and an outer container engaged with said internal surface of said first interior compartment, for containing said inner container.

5. The plant package of claim 4, wherein said second surface of said divider has a reflective coating to assist in better distributing light to said plant within said second interior compartment.

6. The plant package of claim 5, wherein said divider includes an intermediate layer between said first and second layers, said intermediate layer of a more compressible material than said first layer for conforming to and surrounding said live plant stem.

7. The plant package of claim 6, wherein said first surface of said divider engages an opening of said outer container and an opening of said inner container for maintaining the position of said containers with respect to one another.

8. The plant package of claims 1 or 2, wherein said shelf is integral with said shell and substantially surrounds said package interior.

9. The plant package of claim 8, wherein said shelf has a substantially convex cross-sectional configuration from within the package.

10. The plant package of claim 8, wherein said shell is of a polymer material and a portion of said shell defining said first interior compartment has a thickness substantially impermeable to water vapor, and for supporting said container.

11. The plant package of claim 10, wherein said portion of said shell forming said first interior compartment includes a rib for supporting said container.

12. The plant package of claim 8 wherein said shell is of a polymer material wherein a portion of said shell defining said second interior compartment has a thickness substantially more permeable to oxygen and carbon dioxide molecules than said first interior compartment.

13. The plant package of claim 8 wherein a said shell is of a polymer material wherein a portion of said shell defining said first interior compartment has a thickness substantially less permeable to water vapor, and for supporting said container, and a portion of said shell defining said second interior compartment is thinner than said first interior compartment shell portion and is substantially more permeable to oxygen and carbon dioxide molecules.

14. The plant package of claim 2, wherein said shell first element has a substantially cylindrical configuration, a top portion, a bottom portion, and an opening, and said second element is sealing engaged within said opening.

15. The plant package of claim 14 wherein said second element of said shell has an exterior surface having an inset bed portion formed therein for receiving a panel for engaging said shell and a bead portion surrounding said inset bed portion for maintaining said panel within said inset bed portion.

16. The plant package of claim 15 wherein said exterior surface of said second element includes a compartment formed therein for receiving an item of manufacture which is maintained within said compartment by said panel.

17. The plant package of claim 1, wherein said sealed shell comprises first and second hinged elements, each of said elements having an internal surface forming a portion of said package interior and a shelf, said first element having a substantially cylindrical configuration, a top portion, a bottom portion, and an opening, and said second element for sealing engagement within said opening.

18. The plant package of claims 14 or 17, wherein said first and second shell elements are sealed together surrounding said opening in said first element.

19. The plant package of claim 18, wherein said top portion of said first element has a substantially spherical configuration forming a lens for magnifying the live plant within said second interior compartment.

20. A plant package for a live plant having a stem, roots and rooting medium surrounding the roots, comprising:

a self-supporting, partially light transmissive, sealed polymer shell having an internal surface defining a package interior, and a shelf on said internal surface, said shell shelf defining first and second interior compartments of said shell for containing said roots and stem, respectively, said portion of said shell defining said first interior compartment having a thickness substantially impermeable to water vapor, and a portion of said shell defining said second interior compartment is thinner than said first interior compartment shell portion and is substantially more permeable to oxygen and carbon dioxide molecules, a container for said roots and rooting medium surrounding said roots, engaged within said first interior compartment, and a semi-rigid divider engaged with said stem, shelf and container, and forming a water vapor barrier intermediate said first and second interior compartments.

21. A plant package for a live plant having a stem, roots and rooting medium surrounding the roots, comprising:

a self-supporting, light transmissive, sealed polymer shell having an internal surface defining a package interior, and a shelf on said internal surface, said shell shelf defining first and second interior compartments of said shell for containing said roots and stem, respectively, said portion of said shell defining said first interior compartment having a thickness which is greater than a portion of said shell defining said second interior compartment which is substantially more permeable to oxygen and carbon dioxide molecules, an inner container for said roots and rooting medium surrounding said roots, an outer container engaged with said internal surface of said first interior compartment and containing said inner container, and a semi-rigid divider engaged with said stem, shelf and container, and with said outer and inner containers forming a water vapor barrier intermediate said first and second interior compartments.

22. The plant package of claims 20 or 21, wherein said divider includes a first surface forming a part of said first interior compartment and of a compressible breathable material for form fitting engagement with said container, and a second surface engaged with said shelf and forming a part of said second interior compartment and of a material substantially impermeable to the passage of water vapor between said first and second interior compartments.

23. The plant package of claim 22, wherein said sealed shell comprises first and second hinged elements, each of said elements having an internal surface forming a portion of said package interior and a shelf, said first element having a substantially cylindrical configuration, a top portion, a bottom portion, and an opening, and said second element is sealingly engaged within said opening.

24. A plant package for a live plant having foliage and roots supported in a container, said package comprising:

a self - supporting, light transmissive, polymer shell having first and second elements adapted for sealed and mating engagement, and defining a sealed interior package for live plant;

each of said elements including an integral shelf portion having a substantially convex cross-sectional configuration forming a continuous shelf within said interior package for engagement with said container, and defining a foliage compartment and a root compartment within said interior package;

a first wall portion of said first element defining said foliage compartment having a thickness which is substantially permeable to oxygen and carbon dioxide molecules, said wall having a top surface with a substantially spherical configuration for receiving and displaying foliage;

a second wall portion of said first element defining said root compartment having a thickness greater than said foliage compartment wall portion, and together with said container forming a substantially impermeable water vapor barrier, said second wall portion having a bottom surface with a rib section for supporting said container;

said first shell element having an opening intermediate said top and bottom surfaces for receiving said second element; and a seal surrounding said opening intermediate said first and second elements for preventing the transmission of water vapor through said shell and the entrance of microbials and other foreign matter to the package interior.

25. A plant package as set forth in claim 24, wherein said spherical top surface of said first element first wall portion defines a convex lens for enhancing light distribution to said foliage compartment and live plant.

* * * * *